United States Patent [19]

Isaka et al.

[11] 4,380,966

[45] Apr. 26, 1983

[54] DEVELOPMENT APPARATUS

[75] Inventors: Kazuo Isaka; Kimio Nakahata, both of Kawasaki; Masaaki Sakurai, Hanno; Tsuyoshi Watanabe, Kawasaki; Fumitaka Kan, Tokyo; Kenji Takeda, Kawasaki, all of Japan

[73] Assignee: Canon Kabushiki Kaisha, Tokyo, Japan

[21] Appl. No.: 309,383

[22] Filed: Oct. 7, 1981

[30] Foreign Application Priority Data

| | | | |
|---|---|---|---|
| Oct. 11, 1980 | [JP] | Japan | 55/142204 |
| Sep. 30, 1981 | [JP] | Japan | 56/155225 |
| Sep. 30, 1981 | [JP] | Japan | 56/155226 |
| Sep. 30, 1981 | [JP] | Japan | 56/155227 |

[51] Int. Cl.[3] ..... G03G 15/09

[52] U.S. Cl. ..... 118/651; 118/657

[58] Field of Search ..... 118/657, 658, 651

[56] References Cited

U.S. PATENT DOCUMENTS

| | | | |
|---|---|---|---|
| 3,176,652 | 4/1965 | Mott et al. | 118/658 |
| 4,102,305 | 7/1978 | Schwarz | 118/658 X |
| 4,272,563 | 6/1981 | Steck et al. | 427/131 X |

FOREIGN PATENT DOCUMENTS

| | | | |
|---|---|---|---|
| 2029279 | 3/1980 | United Kingdom | 118/657 |

*Primary Examiner*—Bernard D. Pianalto

*Attorney, Agent, or Firm*—Fitzpatrick, Cella, Harper & Scinto

[57] ABSTRACT

A development apparatus has a developer supporting member having a magnet therein and a thickness controlling member for the developer, the developer being a magnetic one-component developer which is applied to the surface of the developer supporting member by means of the thickness controlling member, the applied surface of the developer supporting member being brought into a position opposed to a latent-image carrying member to develop the latent image thereon, the surface of the developer supporting member being roughened by sand blast treatment with irregularly shaped and/or sized particles.

38 Claims, 11 Drawing Figures

DEVELOPMENT APPARATUS

BACKGROUND OF THE INVENTION

1. Field of the Invention

This invention relates to a development apparatus utilizing a magnetic one-component toner as developer.

2. Description of the Prior Art

There is known and has been broadly used such a development method utilizing a conductive, magnetic one-component toner as disclosed in U.S. Pat. No. 3,909,258 and others. In this development method, the toner is required essentially to be electrically conductive. The electrically conductive toner brought a certain difficulty in transferring the toner image on a latent-image carrying member onto a final-image supporting member such as conventional paper sheet or the like under an electric field.

In order to overcome such a problem in the prior art, the applicant had proposed improved development methods, for example, by U.S. patent application Ser. Nos. 58,434 and 58,435 (British Laid-open Patent Application Nos. 2,028,176 and 2,030,478). The proposed methods are characterized by the steps of applying a magnetic insulation toner onto a cylindrical developer supporting member having magnets contained therein, in a uniform thickness, and bringing the applied toner into a position opposed to a latent-image carrying member with no contact for development. At this time, a low-frequency alternating voltage is applied between the developer supporting member and the latent-image carrying member to cause the toner to reciprocate therebetween so that the development can be effectively made with excellent reproducibility in gradation, with no background fog and with no reduced ends of the image. In the methods, the transferring is facilitated since the toner is electrically insulative.

In the proposed development methods, it is extremely important to apply the toner onto the developer supporting member in a uniform thickness. If the toner layer has excessive thickness on the developer supporting member, the toner would not only contact with the latent-image carrying member, but also provide insufficient charge due to the friction between the toner and the developer supporting member. On the other hand, if the toner image has insufficient thickness, the developed image would be insufficient in density since the amount of the toner used in development is reduced.

There are methods for forming a uniform toner layer on the developer supporting member by use of an applying blade located at the outlet of a toner container as shown in FIGS. 1 and 2.

In such a method as shown in FIG. 1, a blade 1 of elastomeric material such as rubber or the like is contacted with a developer supporting member 2 under pressure to control the thickness of a toner layer 3.

In such a method as shown in FIG. 2, a blade 1*a* of magnetic material is located at a position opposed to one of the magnetic poles $N_1$ of a fixed magnet 4 which is contacted with the inside of the developer supporting member 2. Toner particles 3 are stacked one above another along lines of magnetic force between the above magnetic pole $N_1$ and the magnetic blade. The stacks of toner are swept by the edge of the blade to control the thickness toner layer under the action of magnetic force. See U.S. patent application Ser. No. 938,494, for example. (See British Laid-open No. 2,006,054).

In FIGS. 1 and 2, reference numeral 7 designates a developing device containing the toner 10, and reference numeral 9 denotes a latent-image carrying member such as a photosensitive drum in electrophotography and an insulator drum in electrostatic recording. The latent-image carrying member will be called a photoreceptor or photosensitive drum hereinafter.

In accordance with the above-mentioned methods, toner can be applied to the developer supporting member 2 to form the substantially uniform layer 3. In practice, however, it has been found in experiments that it may be difficult to stably form uniform toner layers on the above developer supporting member 2 over a prolonged period of time. It has been also found that it becomes more difficult to form uniform toner layers, particularly where the toner used is remarkably poor in flow characteristics, where the toner has aggregated, etc.

If the toner layer on the developer supporting member 2 (hereinafter called sleeve) has irregular thickness, the developed image also has irregularity so that a good image cannot be obtained. When such a phenomenon causing the irregularity was observed in detail, the following matters have been found:

When the toner layer is controlled in thickness by means of the blade 1*a*, the toner material protrudes outwardly at that portion of the blade 1*a* adjacent to the photoreceptor 9, shown by "A" in FIG. 2, to form a mass of toner $\mathbf{10}_1$ in the portion A as shown in FIG. 3. When the mass of toner $\mathbf{10}_1$ has grown to a critical amount, a portion of the toner mass is moved onto the sleeve 2 under the rotation thereof to form an irregularity in the toner layer as shown by 3' in FIG. 3. The irregularity 3' in the toner layer leads to any irregularity in the developed image. That is, the developed image will be irregular in density or have any fog corresponding to the irregularity in the toner layer. The irregularity 3' on the toner layer assumes varying shapes such as rectangular spots, corrugated spots, corrugated patterns and others which can be considered to produce depending upon the critical amount of the toner mass $\mathbf{10}_1$ in the portion A, ambient factors and the like.

The applicant has proposed an effective method for overcoming problems involved by the above irregularity in the toner layer as disclosed in U.S. patent Ser. No. 138,909. This method prevents the toner irregularity from being produced on the toner layer by providing an irregular or rough surface on the above sleeve in the direction of movement. Such rough surface is considered to be effectively operative because the frictional force between the sleeve surface and the toner is increased to reduce the slipage therebetween so that the toner can protrude outwardly through the gap between the sleeve surface and the blade edge in a stable manner and because the toner mass of upstream the blade is periodically subjected to fine vibrations due to the circumferential irregularity of the sleeve surface so that the toner mass can be collapsed to bring the toner particles into good flow condition.

SUMMARY OF THE INVENTION

It is an object of this invention to overcome the above disadvantages in the prior art and to provide an improved development apparatus in which developer can be always applied to the surface of a developer supporting member in a stable fashion to form a uniform developer layer with no irregularity.

Another object of this invention is to provide an improved development apparatus which can form images with no change in density.

Still another object is to provide a development apparatus which can more effectively carry the toner.

A further object is to provide a development apparatus which can prevent the surface of a developer carrying means from wearing.

A further object is to provide a development apparatus which can prevent the toner from welding to the surface of a developer carrying means.

In order to accomplish the above objects, this invention provides a development apparatus comprising a developer supporting means for carrying a magnetic-field producing means contained therein and a thickness controlling means for the developer, said developer being a one-component magnetic developer and applied to the surface of said developer supporting means by said thickness controlling means, the applied surface of said developer supporting means being brought into a position opposed to a latent-image carrying means to develop the latent image thereon, the surface of said developer supporting means being roughed by sand blast treatment. In the development apparatus, the surface of the developer carrying means may be subjected to plating or anodized aluminum treatment after the sand blast treatment. Furthermore, the surface of the developer supporting means may be subjected to sand blast treatment with particles shaped and/or sized regularly or irregularly after it has been previously subjected to anodized aluminum treatment.

The above and other objects and features of this invention will be more apparent from reading the following detailed description with reference to the accompanying drawings.

DETAILED DESCRIPTION OF PREFERRED EMBODIMENTS

Figure 4:
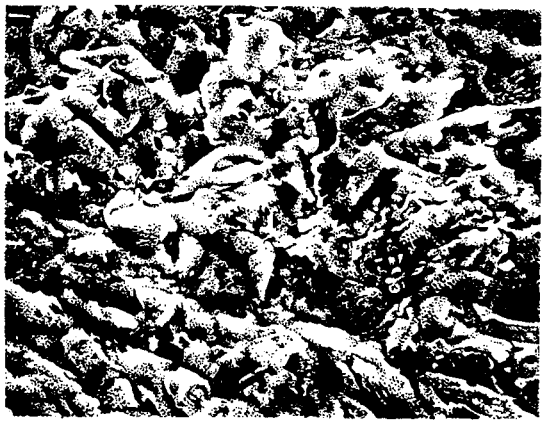
FIG. 4 is an enlarged view taken by an electron microscope, showing an example of the surface of a sleeve which has been subjected to surface roughing treatment.

The surface of a developer carrying means, which is an object of this invention, is roughened over the entire area thereof to form a great number of fine recesses or projections disposed at random as seen from the electron micrograph of FIG. 4. This electron micrograph shows the roughed surface of a stainless steel sleeve which is subjected to sand blast treatment with irregular abrasive particles of #800 and is taken by a scan type electron microscope in magnification of 3750 at an angle of 45 degrees relative to the roughed surface.

The roughed surface can be obtained by various different techniques such as sand blasting, liquid horning and the like. In any case, abrasive particles used are preferably particles shaped and/or sized irregularly as described hereinafter.

Figure 5:
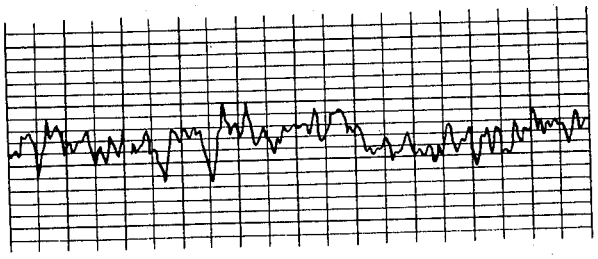
FIG. 5 is a graph plotted by measurements which have been obtained by an accurate surface roughness meter with respect to the roughed surface of FIG. 4.

Although surface characteristics required in this invention cannot be readily described, they can be measured, for example, by the use of a fine surface roughness meter which is commercially available from Tailor Bobson Company, Kosaka Laboratory or others. Measuring the roughed surface of FIG. 4 by means of such a fine surface roughness meter, a wave form as shown in FIG. 5 was obtained. By utilizing such a wave form, the surface characteristics can be controlled. The aforementioned definition with respect to the surface characteristics is obtained on the basis of the wave form mentioned above.

Figure 6:
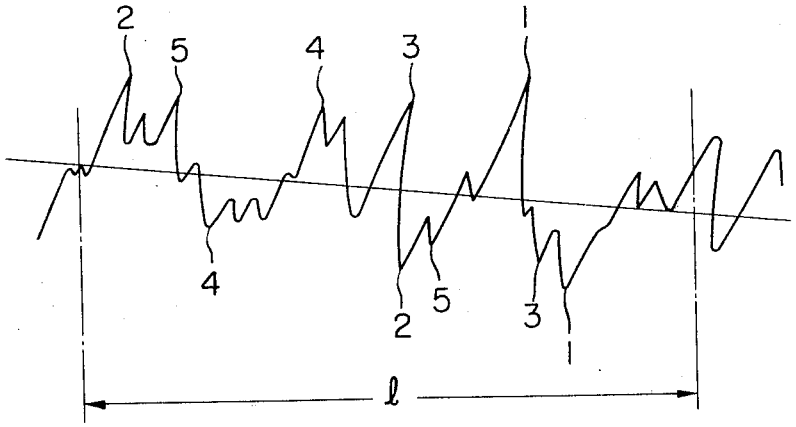
FIG. 6 is a graph illustrating a definition of the surface roughness and pitch.

In this connection, the surface roughness is estimated by JIS ten-point average roughness (RZ) "JIS B0601". Namely, the surface roughness is represented by a distance (micrometer, $\mu$m) between a straight line which is parallel to the average line in a portion of the profile curve picked up by a reference length l and passes through the third peak counted from the maximum peak and a straight line which passes through the third valley counted from the maximum depth. The reference length l is 0.25 m/m. By counting the number of peaks higher $0.1\mu$ or more than two adjacent valleys along the reference length of 0.25 m/m, pitch P is determined from the following formula:

$P=250(\mu)$/the number of the above counted peaks. Concretely speaking, the roughened surface in this invention has preferably various sized recesses and protrusions disposed at random in pitch P (average spacing between adjacent large recesses or protrusions in FIG. 6) in the range of 2 to $50\mu$ with the above defined surface roughness d in the range of 0.1 to $8\mu$.

In such a development system that a low-frequency alternating voltage is applied between a developer supporting member 2 and a latent-image carrying member 9 to cause the developer to fly from the developer supporting member toward the latent-image carrying surface, the electric field tends to concentrate on the recesses and protrusions of the roughened surface of the developer supporting member due to the alternating voltage to generate any disturbance in images. In this case, the surface roughness d in the surface of the developer supporting member is preferably in the range of 0.1 to $4\mu$.

The surface of the developer supporting member or sleeve 2 may be roughened by bead blast treatment using spherical particles, sand paper treatment in which the sleeve surface is axially rubbed by sand paper to form circumferential irregularity thereon, chemical treatment or the like in addition to the above sand blast treatment using the irregularly shaped and/or sized particles.

The former methods (hereinafter called methods "B"), however, provide rounded protrusions on the roughed surface of the sleeve unlike the sand blasting with the irregularly shaped and/or sized particles (hereinafter called method "A"). The method "A" provides sharp protrusions on the roughed surface which are more important in providing the surface irregularity than the entire surface roughness. It has been found from experiments that there is a complete difference between the methods "A" and "B" in improving the carrying of the developer to eliminate any unevenness in the developer layer formed. The method "A" is superior to the methods "B".

Figure 7:
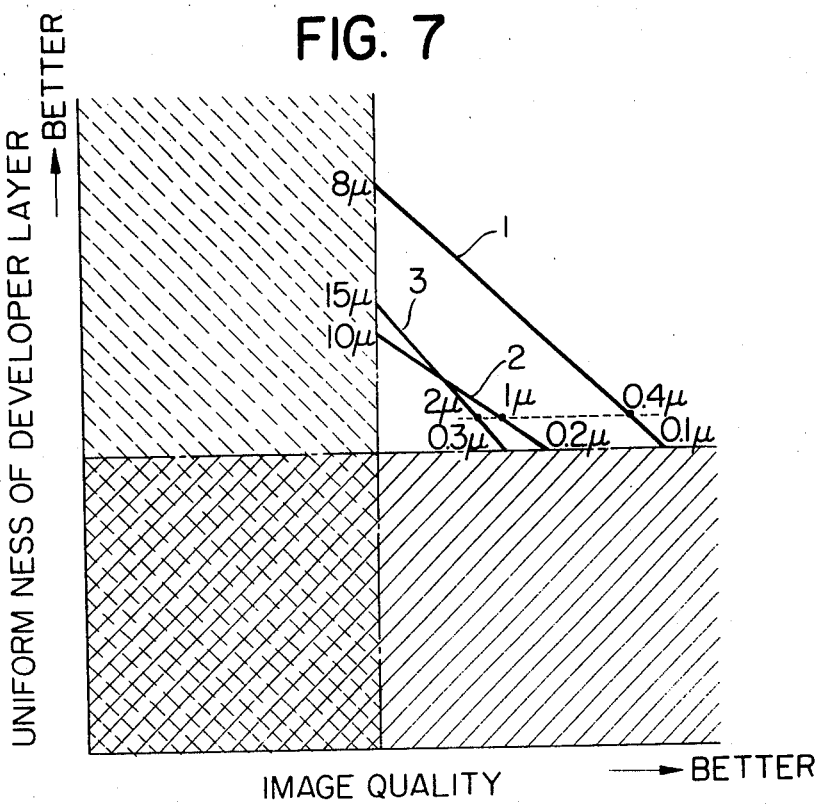
FIG. 7 is a graph showing a relationship between uniformness of developer layer and image quality in view of the surface roughness obtained by different surface roughing processes.

FIG. 7 shows a relationship between uniformness of developer layer and image quality in view of surface roughnesses obtained by various surface roughening methods. The vertical axis designates the uniformness of developer layer and the horizontal axis denotes the image quality. The area shown by slanted solid lines is one in which no development can be made due to the irregularity on the developer layer while the area shown by slanted broken lines is such an area as producing poor images. A straight line (1) designates a relationship between various surface roughnesses obtained by treating sleeve surfaces with the sand blasting which uses irregular particles and the developer layer uniformness and image quality. A straight line (2) denotes similar relationship in case of roughening the sleeve surfaces by sand paper. A straight line (3) designates similar relationship in case of blast treatment with regularly shaped and sized particles.

From the relationship shown by the straight line (1), it will be found that the surface roughness of $0.1\mu$ or less produces the irregularity of developer layer while the surface roughness of $8\mu$ or more makes the image quality poor. Area between $0.1\mu$ and $8\mu$ in surface roughness is a proper range for development. Similarly, it will be found that there is a proper area between $0.2\mu$ and $10\mu$ in the relationship shown by the straight line (2) and that there is a proper area between $0.3\mu$ and $15\mu$ in the relationship shown by the straight line (3). However, the levels and inclinations in the straight lines (1) to (3) are different from one another so that the surface roughnesses will be different from one another in order to obtain the developer layer uniformnesses in the same level with respect to the different roughening methods. For example, if it is desired to obtain the developer layer uniformnesses in the relationships shown by the straight lines (2) and (3) which corresponds to the surface roughness of $0.4\mu$ in the relationship shown by the straight line (1), the surface roughness in the relationship (2) should be $1\mu$ while the same in the relationship (3) is required to be $2\mu$.

By using the particular roughed surface of the developer supporting member 2 which is subjected to the sand blast treatment with the irregular particles according to this invention, uniform developer layers may be formed on the roughened surface of the developer supporting member 2 so that development will be always effectively carried out with no irregularity.

Also, since the pitch and the like with respect to the recesses and protrusions in the surface roughness obtained according to this invention provide sufficiently high developer layer uniformness and image quality in such a relatively small scope as above-mentioned, substantially no disturbance in images will be produced due to the concentration of electric fields onto the recesses and protrusions in the roughened surface even if the alternating voltage is applied between the developer supporting member 2 and the latent-image carrying member 9 so that the high quality images can be obtained with very improved definition.

Where the surface is subjected to the roughening treatment with irregular particles, the protrusions formed over the entire surface serves to prevent the irregularity of the developer layer in a very effective manner. This is advantageous in that the dispersion of the surface roughness has a widened latitude.

Embodiments of this invention will now be described in detail with reference to the drawings.

Figure 8:
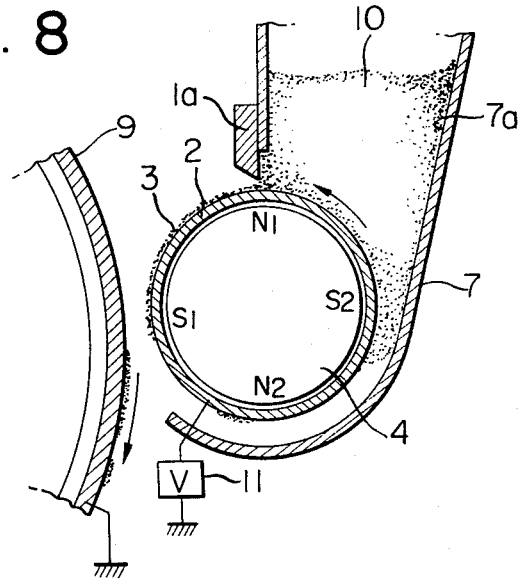
FIG. 8 is a cross-sectional view of a sleeve according to this invention.

FIG. 8 is a cross-sectional view of one embodiment of a development apparatus to which this invention is applied. In this figure, 4 is a fixed magnet roller, 2 is a movable sleeve, 7 is a developer container, 7*a* is a hopper section, 1*a* is a blade of magnet or magnetic material for controlling the developer layer in thickness, 9 is a photosensitive drum, and 10 is a magnetic one-component toner. Furthermore, 11 designates a source of electric power for applying an alternating voltage between the sleeve 2 and the photosensitive drum 9, which will not be further described herein since such a power source has been described in the aforementioned U.S. patent applications Ser. Nos. 58,434 and 58,435. In this development apparatus, the toner 10 is contained in the hopper 7*a* and drawn onto the sleeve 2 under the magnetic force of the magnet roller 4. The toner on the sleeve is charged under the friction between the sleeve and the toner upon rotating the sleeve. The charged condition in the toner is stabilized by a control agent added thereto. As the sleeve is rotated, the toner thereon is moved to the blade section. A magnetic pole $N_1$ is located opposed to the magnetic blade 1*a*. Thus, the toner is controlled to the desired thickness under the action of the magnetic field produced between the blade 1*a* and the magnetic pole $N_1$ and by means of the gap between the blade 1*a* and the sleeve 2. This function and involved advantages will not be described herein since they have been described in detail in said U.S. patent application Ser. No. 938,494. After being controlled by means of the blade 1*a*, the remaining toner in the toner container assumes a flow state as shown by arrows in FIG. 3.

As the sleeve is further rotated, the toner layer 3 is brought into a position opposed to the photosensitive drum 9, and the toner particles in the layer 3 are stacked one above another under the action of the magnetic force in the magnetic developing pole $S_1$. At the same time, the toner particles are reciprocated between an electrostatic latent image on the photosensitive drum and the sleeve under the action of a low-frequency alternating voltage applied therebetween to deposit only on that position of the drum which has latent image charges. Thereafter, the remaining toner particles on the sleeve are moved back to the developer container under the action of the magnetic forces in the magnetic poles $N_1$ and $S_2$ as the sleeve is further rotated.

Figure 9:
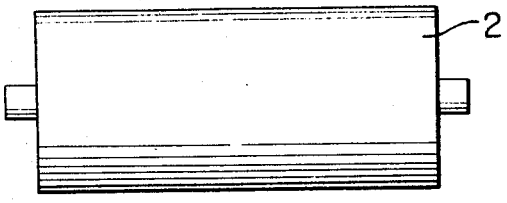
FIG. 9 is a front elevational view of the sleeve shown in FIG. 8.

FIG. 9 is a front elevational view of the sleeve 2 used in the development apparatus of FIG. 8 and having its surface roughed according to this invention.

Figure 1:
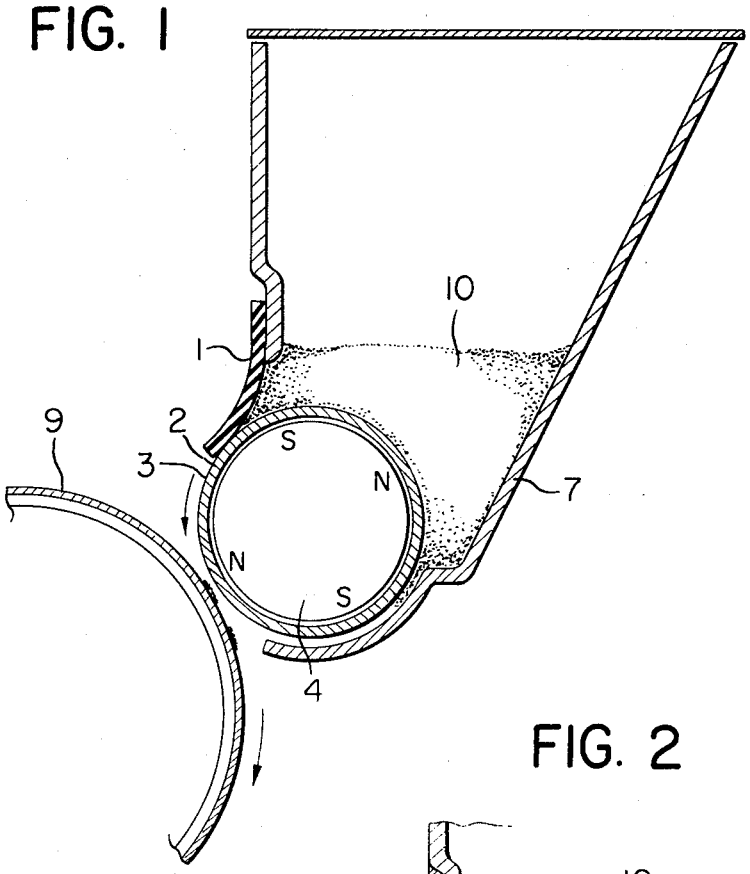
FIG. 1 is a cross-sectional view of a development apparatus using an elastomeric blade.
Figure 2:
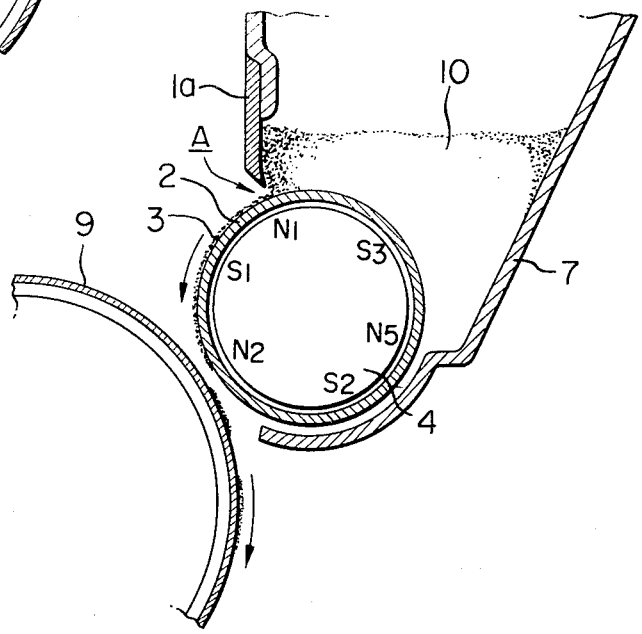
FIG. 2 is a cross-sectional view of a development apparatus utilizing a magnetic blade.
Figure 3:
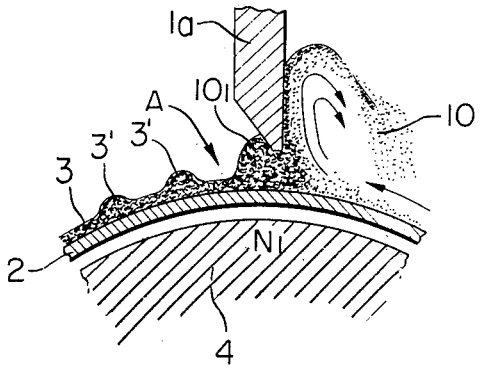
FIG. 3 illustrates a cause producing an irregularity in the applied toner.

If the sleeve has its smooth surface, the toner particles are magnetically aggregated upstream the magnetic blade 1*a* with respect to the direction of rotation of the sleeve 2 to form a large mass of toner which will in turn protrude from the blade 1*a* to form a toner mass $\mathbf{10}_1$ at the portion A on the sleeve resulting in the irregularity of the toner layer thereon as hereinbefore described with reference to FIG. 3. At this time, the toner mass of upstream the blade has the circulating movement of toner particles with relatively large radii as shown by arrows in FIG. 3.

By using a sleeve which has its surface roughened according to this invention, however, no unevenness of toner layer may be produced due to the protrusion of toner mass from the blade. Furthermore, it has been observed that the circulation radii of the toner particles in the toner mass of upstream the blade is reduced. It is believed that those advantages are obtained because the toner mass upstream the blade is finely vibrated periodically by the roughed surface of the sleeve to collapse into its improved flow characteristics. In order to provide this periodical vibration, it has been experimentally confirmed that the pitch P in the roughed surface is preferably in the range of 2 to 50μ.

Furthermore, it has been experimentally confirmed that the surface roughness d should comply with the following requirements.

First, the surface roughness d is preferably in the order of 0.1μ or more for forming the toner layer 3 with a uniform thickness because the surface roughness of less than 0.1μ provides a smaller coefficient of friction between the toner and the surface of the sleeve.

Secondly, the surface roughness is preferably in the range of 0.1μ to 8μ so as to provide sufficient charges to the toner under friction. This is because the surface roughness of less than 0.1μ does not provide sufficient frictional charges due to reduced friction between the toner and the sleeve while the surface roughness of more than 8μ causes toner layers to increase in thickness so that the frictional charges in the toner will be made unstable to disturb developed images.

Thirdly, the surface roughness d is preferably in the range of 0.1μ to 10μ in order to prevent the toner from welding to sleeve. If the surface of the sleeve is smooth, the toner would slip thereon resulting in the welding of the toner. On the other hand, if the surface roughness is more than 10μ, the toner penetrates into the recesses on the roughed surface of the sleeve resulting in also the welding of the toner.

In view of the above requirements, the surface roughness d is preferably in the range of 0.1μ to 8μ in this invention.

In this connection, means particle diameter used in this invention is in the range of 5μ to 30μ, preferably 5μ to 15μ.

In the development apparatus of FIG. 8 where the toner layer 3 is controlled to have the thickness of 50μ to 300μ which is smaller than the gap between the sleeve 2 and the photosensitive drum 9, for example, in the range of 100μ to 500μ, and where the toner particles are reciprocated between the sleeve 2 and the photosensitive drum 9 under the action of an alternating voltage V applied therebetween, it has been confirmed that the surface roughness of more than 4μ causes the toner particles to disperse in all directions resulting in poor image reproduction. This is because the electric alternating fields applied between the sleeve 2 and the drum 9 concentrate on the protrusions in the roughed surface to draw the toner particles. In order to overcome this phenomenon, therefore, the surface roughness d is preferably in the range of 0.1μ to 4μ in this invention.

The embodiments of this invention will now be described more concretely.

The development apparatus shown in FIG. 8 comprises, as a developer supporting member, a non-magnetic sleeve 2 of stainless steel (SUS 304) having a diameter of 50 m/m, and a magnet 4 located within the sleeve which has a magnetic pole $N_1$ of 850 gauss, a magnetic pole $N_2$ of 500 gauss, a magnetic pole of 650 gauss and a magnetic pole of 500 gauss. The apparatus further comprises a magnetic blade 1*a* of iron which forms a gap of 250μ together with the sleeve 2. The toner 10 is a magnetic one-component toner. A bias source of electric power 11 supplies a combination current provided by superposing alternating current on direct current wherein $V_{pp}$ is 1200 V, f is 800 Hz and DC is +100 W.

The magnetic one-component toner comprises, by weight, 60% of polystyrene, 35% of magnetite, 5% of carbon black and 25% of negative-charge control agent. This toner further comprises colloidal silica added thereto at 0.2% by weight.

The sleeve 2 is roughened by sand blast treatment with carborundum of #800 at air pressure of 4 $Kg/cm^2$ for two minutes with a distance between the sleeve surface and a blowing nozzle having a diameter of 7 m/m being 100 m/m.

FIG. 4 shows the so obtained surface of the sleeve which is taken by an electron microscope. Data obtained by measuring this roughened surface by the use of a surface roughness measuring meter are indicated in FIG. 5. FIG. 4 is an electron micrograph of the roughed surface taken in a magnification of 3750 at an angle of 45 degrees thereto as hereinbefore described. In FIG. 5, the scale on the vertical axis is represented by 0.2 μ/div. while the scale on the horizontal axis is designated by 50 μ/div. Thus, the above roughed surface of the sleeve has its surface roughness d of 6μ and the pitch P of 20 μm.

When the development apparatus having the above values and measurements was actually used to develop latent images, toner layers coated on the roughened surface of the sleeve 2 were very improved, resulting in no irregularity therein. When copying was further continuously carried out under the same condition, high quality images could always be obtained with no irregularity in development.

Although the carborundum of #800 was used as abrasive particles for blasting in the above operation, other abrasive particles of different gritsand materials can be of course used depending on the size of the blasting nozzle, the distance between the nozzle and the sleeve, the blasting pressure and the material of the sleeve surface. Considering various different experiments, the abrasive particles in the range of #300 to #800 provides particularly preferred results.

In accordance with this invention, the toner or developer 10 can be readily and stably applied to the surface of the sleeve or developer supporting member 2 in the uniformly thin layer 3. Moreover, by suitably selecting the values of the surface roughness dependent on different compositions of the developer 10 used, various different developers can always be charged with preferable and proper charges under friction. Furthermore, the developer will not be welded on the developer supporting member 2 thereby resulting in improved images. Thus, this invention provides an improved development apparatus of this type which is operative effectively and satisfactorily.

It was attempted to continuously develop images by using a sleeve of stainless steel (SUS 304) which has its surface roughened by sand blast treatment with irregular particles of #600. This sleeve did not provide any irregularity in development, but caused the toner to weld on the roughened surface thereof in dotted pattern and linear pattern parallel to each other in the circumferential direction of the sleeve. This welding is particularly remarkable where the pressure fixing toner is used.

Observing the toner-welded portion of the sleeve by use of a scan type electron microscope, it has been found that the toner particles are rubbed and welded against a great number of fine protrusions on the roughed surface of the sleeve. It has been also found that image quality is inversely affected in such a place as welded by the toner particles too much.

For studying the above phenomenon, the inventors carried out such experiments as described in the following comparative examples. The apparatus used in these experiments can be improved according to this invention. One embodiment of the improved apparatuses according this invention will be described after the comparative examples have been explained.

Comparative Example 1

The same development apparatus as in the embodiment of this invention was used except the sleeve 2.

The sleeve 2 is of non-magnetic stainless steel (SUS 304) and has its surface roughened by sand blast treatment with silicon carbide particles of #300 as abrasive particles at air pressure of 4 Kg/cm$^2$ for two minutes, the particles being blown against the sleeve surface from a blowing nozzle which has a diameter of 7 m/m and spaced away therefrom by a distance of 100 m/m.

When this development apparatus was actually used to develop latent images, the toner layers coated on the roughened surface of the sleeve 2 were very improved with no irregularity. After twenty-thousand sheets of copy paper had been developed by using the above sleeve, however, mist and fog like lines were produced in the background. At this time, it was observed that the toner particles were welded on the roughened surface of the sleeve in many lines and dots and that the welded portions of the sleeve surface provided fog on to images.

Comparative Example 2

The same development apparatus as in the embodiment of this invention was used except the sleeve 2.

The sleeve 2 is of non-magnetic stainless steel (SUS 304) and has its surface roughened by sand blast treatment with silicon carbide particles of #800 at air pressure of 4 Kg/cm$^2$ for two minutes, the particles being blown against the sleeve surface from a blowing nozzle which has a diameter of 7 m/m and spaced away therefrom by a distance of 100 m/m.

When the above development apparatus was actually used to develop latent images, the toner layers coated on the roughened surface of the sleeve 2 were very improved without any irregularity. After fifty-thousand sheets of copy paper had been used to develop latent images by use of the above sleeve, the toner particles were welded on the sleeve surface only in a few lines so that the sleeve surface was maintained in a relatively preferred condition without any irregularity. When the sleeve was subsequently run idle in the presence of the toner for ninety-two hours, irregularity was found on the toner coating. When images were formed in such a state, irregular spot-like fog was found on the backgrounds of the copied sheets. Observing the roughened surface of the sleeve by use of a scan type electron microscope, the protrusions disposed between the recesses at random were substantially worn out.

In this connection, the hardness of the sleeve surface was 1000 Hv in the comparative example 1 and 200 Hv in comparative example 2, respectively.

A further embodiment of this invention provides a development apparatus improved to apply and form thin layers of developer on the surface of the developer supporting member in a continually stable and uniform manner without the above welding of toner in the prior art. In the further embodiment, the surface of the developer supporting member is characterized in that it is treated by hard plating after the surface has been roughened by sand blast treatment with irregularly shaped and sized particles.

The development apparatus according to the further embodiment will now be described in detail.

Figure 10:
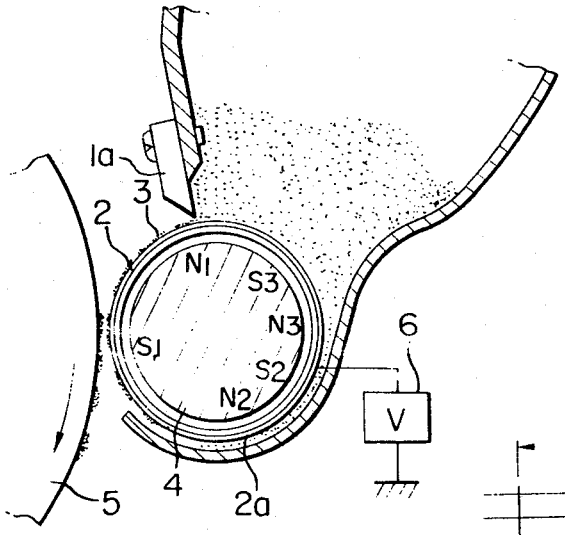
FIG. 10 is a cross-sectional view of a development apparatus using an embodiment of this invention.

The development apparatus is similar in construction to that of FIG. 10, wherein parts similar to those of FIG. 8 are shown by similar reference numerals. The magnet 4 had a magnetic pole $N_1$ of 700 gauss, a magnetic pole $S_1$ of 800 gauss and magnetic poles $N_2$, $S_2$, $N_3$ and $S_3$ all of which are of 500 gauss. A gap between the sleeve 2 and the drum 5 was maintained at 0.3 mm while a gap between the sleeve 2 and the blade 1*a* was held at 0.25 mm. A bias source of power 6 provided a combination current obtained by superposing alternating current on direct current wherein $V_{pp}$ was 1200 V, f was 800 Hz and DC was +100 V. In such a construction, copying was carried out at copy speed of 12 sheets/minute under jamping due to the above power source. The sleeve 2 was made of non-magnetic stainless steel (SUS 304) and had its surface roughened by sand blast treatment with silicon carbide particles of #300 at air pressure of 4 Kg/cm$^2$ for two minutes, the particles being blown against the sleeve surface from a blowing nozzle which had a diameter of 7 mm and was spaced therefrom by a distance of 100 mm. After the sand blast treatment, the roughened surface of the sleeve 2 was coated with a hard chrome plating 2*a* having a thickness of 2$\mu$. Preferred results were obtained when the hard chrome plating was used in the range of 1 to 20$\mu$ in thickness. When the development apparatus of the above construction was actually used to develop latent images, the toner coating on the surface of the sleeve 2 was very improved without any irregularity. After fifty-thousand sheets of copy paper had been copied by use of the above sleeve, high quality images were always obtained. At this time, no irregularity and welding was found on the surface of the sleeve. Observing the sleeve surface by use of a scan type electron microscope, it was found that there was no wear thereon, maintaining its original state. Thus, the aforementioned problems in the prior art can be completely eliminated according to this invention.

Figure 11:
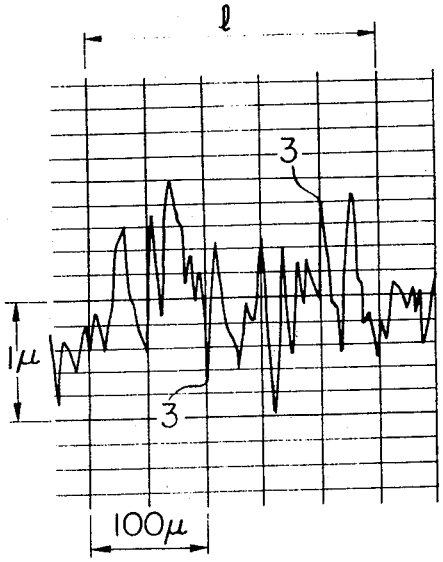
FIG. 11 is a graph showing, in wave-shape, measurements which have been obtained in measuring the roughness in the surface of the sleeve.

In the above experiments, the toner used comprised, by weight, 100 parts of polyethylene, 70 parts of magnetic powder, 2 parts of charge control agent and 1% of silica finally added thereto to form a pressure fixing toner. It is difficult to readily define the surface roughness of the above sleeve since it has recesses and protrusions disposed at random throughout the surface thereof. Measuring the roughened surface of the above sleeve by use of a fine surface roughness measuring meter which is commercially available from Tailor Bobson Company or Kosaka Laboratory, a wave form as shown in FIG. 11 is obtained and serves to control the surface properties. In FIG. 11, mean roughness Rz is 1.5μ and pitch is 19μ. In this connection, the surface roughness is represented by JIS ten-point mean roughness (Rz) (JIS B0601) as hereinbefore described.

When images was developed after the sleeve had been run idle for 500 rrs in the presence of the toner, high quality images could be still obtained. And yet, the surface of the sleeve had no worn portion and maintained its original state under observation of the scan type electron microscope.

Although the stainless steel sleeve was used in the above embodiment, other non-magnetic materials such as aluminum, copper and the like can be used to form the sleeve. In experiments carried out varying the particle diameter of the sand blasting particles and the air pressure for blowing, it has been found that the roughed surface of the sleeve is effective in final mean roughness d of 0.1–8μ and pitch P of 2–50μ, particularly in mean roughness d of 0.3–3.0μ and pitch of 5–30μ.

It will be apparent from the above description that this embodiment provides a development apparatus which can be stably operated with high performance for an extended period of time by use of the developer supporting member having its surface which has roughened by sand blast treatment with irregular shaped and sized particles and thereafter subjected to hard plating treatment.

It has been confirmed that the same advantage as in the above-mentioned embodiment of this invention can be obtained by a developer supporting member having its surface which is subjected to sand blast treatment and thereafter to anodized aluminum treatment. This will now be described in detail.

The same development apparatus as in FIG. 10 was used wherein the magnet 4 has a magnetic pole $N_1$ of 820 gauss, a magnetic pole $S_1$ of 820 gauss and magnetic poles $N_2$, $S_2$, $N_3$ and $S_3$ all of which are of 500 gauss. A gap between the sleeve 2 and the drum 5 was maintained at 0.25 mm while a gap between the sleeve 2 and the blade 1*a* was held at 0.2 mm. A bias source of electric power 6 provided a combination current formed by superposing alternating current on direct current wherein $V_{pp}$ (peak-to-peak) is 1300 V, f is 800 Hz and DC is +100 V. Copying was carried out at copy speed of 30 sheets/minute under jamping due to said bias power source. The surface of the sleeve 2 was roughened by sand blast treatment with silicon carbide particles of #800 as irregular abrasive particles at air pressure of 3 Kg/cm$^2$ for about one minute, the particles being blown against the sleeve surface from a blowing nozzle which has a diameter of 7 mm and is spaced away from the sleeve surface by a distance of 100 mm. Thereafter, the roughened surface of the sleeve was subjected to anodized aluminum treatment in 15% sulfuric acid solution by an anodizing process to form an anodized aluminum layer 2*a* having a thickness of 30μ. The abrasive particles may be particles of other materials such as $Al_2O_3$, $SiO_2$, $Fe_2O_3$, $TiO_2$ and the like. When the development apparatus of the above construction was actually used to develop latent images, it was found that toner coatings on the roughened surface of the sleeve 2 was very improved with no irregularity. No welding or toner was found on the sleeve. Even after fifty-thousand copying sheets had been developed, high quality images was always obtained without reduced density therein. Furthermore, the surface roughness of the sleeve surface was maintained at its original state, that is, 0.5μ.

These advantages are due to the fact that the sleeve surface is insulated by the anodized aluminum layer to prevent the images from decreasing in density, and the fact that the roughened surface of the sleeve is slightly smoothed by the anodized aluminum treatment so that the toner particles will not be rubbed against the sharp protrusions of the roughened surface resulting in no welding of toner. Similar advantages can be obtained by the sleeve surface roughened by sand blast treatment with regularly shaped and sized abrasive particles such as glass beads, steel balls, ferite balls and the like. Moreover, the sleeve surface is hardened by anodized aluminum treatment to prevent it from wearing. Thus, this embodiment overcomes the aforementioned problems in the prior art.

EXAMPLE 1

The surface of sleeves were roughened by sand blast treatment with abrasive particles of different particle diameters for different air pressures to obtain surface roughnesses of the sleeve surfaces in the range of 0.05–10μ, and thereafter subjected to anodized aluminum treatment. These sleeves were assembled into the development apparatus shown in FIG. 10 and used for development. When the sleeves had the surface roughnesses in the range of 0.1μ or less, the toner particles slipped on the sleeve surfaces so that uniform layers of toner could not be coated thereon to produce irregularities. On the other hand, when the surface roughnesses of the sleeve surfaces were in the range of 8μ or more, the toner particles did not slip on thereof, without any irregularities. However, the toner particles penetrated into the recesses in the roughed surfaces of the sleeves to provide insuffient friction between the toner and the sleeve surfaces so that the toner could not charged to reduce its developing ability resulting in developed images decreased in density. If the surface roughness of the sleeves was in the range of 0.3–3.0μ and the pitch of roughness was in the range of 5–30μ, the sleeves were particularly effective in development.

Subsequently, image development was carried out after the sleeves had been run idle for 500 rrs in the presence of the toner. High quality images were still obtained and yet the sleeve surfaces were maintained at their original states without any abrasion under observation of the scan type electron microscope.

EXAMPLE 2

After sleeve surfaces had been roughened by sand blast treatment, they were coated with anodized aluminum layers having different thicknesses and used with the development apparatus of said example. When the thickness of the anodized aluminum layers was in the range of 5μ or less, it was difficult to cover some roughened surfaces with those anodized aluminum layers. On the other hand, when the thickness of the anodized aluminum layers was in the range of 50μ or more, they would completely cover the roughened surfaces to provide smooth surfaces. Furthermore, the electric field between the electrostatic carrying surface and the sleeve surfaces was remarkably reduced to restrain the developing resulting in poor images. Thus, the roughened surfaces of the sleeves are effective if the thickness of the anodized aluminum layers is in the range of 5μ–50μ. Furthermore, it has been found that the abrasion in the sleeves can be positively restrained if anodized hard aluminum layers are used to cover the roughened surfaces of the sleeves.

When continuous image development was carried out by using a sleeve of stainless steel (SUS 304) whose surface was roughened by sand blast treatment with irregular abrasive particles of #600, there was no irregularity, but the following phenomena were brought about.

(1) When an original having a large white-colored background which required extremely small amount of toner was copied continuously with 300–500 copy sheets, density in images decreased from 1.1 to 0.9.

(2) When an original black-colored over the entire area thereof was continuously copied by the development apparatus in which the density of image had decreased as aforementioned, the density began to return to 1.1 after 30–50 copy sheets had been developed.

(3) When a conventional original was copied continuously with tens of thousands of copy sheets, problems were substantially brought about in practice with some irregularity.

Measuring the particle diameter of the toner on the sleeve surface which brought about the decreased density of image as in the above phenomenon (1), the toner particles having particle diameters of 1–5μ were mainly present on the sleeve surface. These particle diameters are apparently smaller than those of the toner particles in the hopper, which are of mean particle diameter in the range of 8–13μ. It is believed that this causes the change of image density. The reason is that, when the toner particles are charged under friction with the sleeve and moved onto the sleeve surface by reflective force, toner particles having smaller particle diameter (1–5μ) are first drawn onto the sleeve surface rather than other toner particles having average particle diameter (8–13μ) to form a thin layer coated on the sleeve surface. Thus, the toner particles having particle diameter of 5μ or more, which contribute mostly to development, are not sufficiently charged due to insufficient friction with the sleeve 2. Therefore, the image density will be gradually reduced. It has been found that it is effective to insulate the sleeve surface in order to restrain the sleeve coating of fine toner particles due to the reflective force.

Studying the roughened surface of the sleeve when the phenomenon (3) was brought about, it has been found that the roughened surface is worn by the rotation of the sleeve for an prolonged period of time resulting in some irregularity. It has been found that the sleeve surface is preferably hardened in order to prevent such abrasion.

Still a further embodiment of this invention will now be described wherein the surface of a sleeve is first formed with an anodized aluminum layer and therefore subjected to sand blast treatment with irregular shaped and sized abrasive particles.

In this embodiment, the development apparatus shown in FIG. 10 was used wherein the magnet 4 has a magnetic pole $N_1$ of 820 gauss, a magnetic pole $S_1$ of 820 gauss and magnetic poles $N_2$, $S_2$, $N_3$ and $S_3$ all of which are of 500 gauss. A gap between the sleeve 2 and the drum 5 was maintained at 0.25 mm while a gap between the sleeve 2 and the blade 1*a* was held at 0.2 mm. A bias source of electric power 6 provided a combination current formed by superposing alternating current on direct current wherein $V_{pp}$ (peak-to-peak) was 1300 V, f was 1000 Hz and DC was +100 V. Under jamping due to the combination current, copying was carried out at copy speed of 30 sheets/minute. The sleeve 2 was made of aluminum and its surface subjected to anodized aluminum treatment in 15% sulfuric acid solution by the anodizing process to form an anodized aluminum layer 2*a* having a thickness of about 30μ. This sleeve had a diameter or 32 mm. The treated surface of the sleeve was then roughed by sand blast treatment with silicon carbide abrasive particles of #600 as irregular blast abrasive particles at air pressure of 4 Kg/cm$^2$ for 90 seconds, the particles being blown against the sleeve surface from a blowing nozzle which has a diameter of 7 mm and is spaced from the sleeve surface by a distance of 100 mm. The sand blast treatment may be carried out by abrasive particles of other materials such as $Al_2O_3$, $SiO_2$, $Fe_2O_3$, $TiO_2$ and others. When latent-image development was carried out by the above development apparatus, toner coatings on the sleeve surface were very improved without any irregularity. Even after fifty-thousand copy sheets had been passed therethrough, high quality images were always obtained without any decrease of maximum image density $D_{max}$. Furthermore, the surface roughness of the sleeve surface was maintained at its original state, that is, 0.82μ. This development apparatus can overcome the aforementioned problems in the prior art.

EXAMPLE 3

After the anodized aluminum treatment, the surfaces of sleeves were roughened by sand blast treatment with abrasive particles having different particle diameters at different air pressures to provide various surface roughnesses in the range of 0.05–10μ. These sleeves were assembled into the development apparatus shown in FIG. 10 for operation. When the surface roughness was in the range of 0.1μ or less, the toner was not coated on the sleeve surfaces in a uniform layer with irregularities since the toner particles slipped thereon. If the surface roughness was in the range of 8μ or more, the toner particles would not slip on the sleeve surfaces without any irregularity. However, the toner particles penetrated into the recesses in the roughed surfaces to provide insufficient friction therebetween so that the toner particles would not be charged to decrease their development abilities resulting in poor images with reduced densities. The roughened surface of the sleeve was particularly effective if it was in the range of 0.3–3.0μ with the pitch being in the range of 5–30μ.

After the sleeves had been run idle for 500 rrs in the presence of the toner, image development was carried out resulting in high quality images. Observing the roughed surfaces of the sleeves by the scan type electron microscope, it has been also found that the roughened surfaces are maintained at their original states with no abrasion.

EXAMPLE 4

Sleeve surfaces covered with anodized aluminum layers having different thicknesses were roughened by sand blast treatment and used with the development apparatus in said examples. If the thickness of the anodized aluminum layers was in the range of 5μ or less, the sleeve surfaces treated were not sufficiently roughened by the sand blast treatment under the influence of the aluminum material of which the sleeves were made. If the thickness of the anodized aluminum layers was in the range of 50μ or more, electric fields between the electrostatic carrying surface and the sleeve surfaces would be remarkably decreased to restrain the developing originally resulting in poor images. Accordingly, the thickness of the anodized aluminum layers is effectively in the range of 5μ–50μ. In this connection, the anodized aluminum layer having a thickness of 50μ was not accurately formed merely by the anodized aluminum treatment. In this example, therefore, the anodized aluminum layer was first formed with a thickness of about 100μ and then ground into a thickness of 50μ.

It has further been found that any abrasion of the sleeves can positively be restrained by using anodized hard aluminum.

Where the sleeve surface is roughened by sand blast treatment with irregularly shaped and sized particles, welding of the toner on the sleve tends to be produced in the form of dots and lines parallel to the circumferential direction of the sleeve. This is remarkable when the pressure fixing toner is used. Observing such toner welded sleeve portions by the scan type electron microscope, it has been found that the toner particles are rubbed against a great number of fine protrusions in the sleeve surface and welded thereon.

Still a further embodiment of this invention will now be described wherein the surface of a sleeve is covered with an anodized aluminum layer and then roughened by sand blast treatment with regularly shaped and sized particles.

In this embodiment, the development apparatus shown in FIG. 10 was used with the above sleeve in which its magnet 4 had a magnetic pole $N_1$ of 820 gauss, a magnetic pole $S_1$ of 820 gauss, and magnetic poles $N_2$, $S_2$, $N_3$ and $S_3$ all of which were of 500 gauss. A gap between the sleeve 2 and the drum 5 was maintained at 0.25 mm while a gap between the sleeve 2 and the blade 1*a* was held at 0.2 mm. A bias source of electric power 6 supplied a combination current formed by superposing alternating current on direct current wherein $V_{pp}$ was 1300 V, f was 1000 Hz and DC was +100 V. Under jamping due to the combination current, copying was carried out at copy speed of 30 sheets/minute. The sleeve 2 was made of aluminum material and had its surface subjected to anodizing process in 15% sulfuric acid solution to form an anodized aluminum layer 2*a* having its thickness of about 30μ. Thereafter, the treated surface of the sleeve was roughened by sand blast treatment with glass beads of #800 as regular abrasive particles in ball-shape at air pressure of 4 $Kg/cm^2$ for about 120 seconds, the particles being blown against the sleeve surface from a blowing nozzle which had a diameter of 7 mm and was spaced away from the sleeve surface by a distance of 100 mm. The regularly shaped and sized particles may include steel balls and ferite balls. When latent image development was actually carried out by the development apparatus assembled by the above treated sleeve, the toner coating on the sleeve surface was very improved without any irregularity. There was also no welding of toner on the sleeve surface. Even after fifty-thousand copy sheets had been used to develop images, high quality images were always obtained with no reduced image density. Also, the sleeve surface was maintained at its original state with the surface roughness of 0.7μ. The reason is that the sleeve surface is insulated by the anodized aluminum layer to prevent the reduced image density and that the sleeve surface is smoothed by the sand blast treatment with ball-shaped abrasive particles after anodized aluminum treatment to eliminate the sharp protrusions on the roughened surface finally. Furthermore, there was no abrasion due to the hardening of the anodized aluminum treatment. Thus, the development apparatus according to this embodiment can overcome the aforementioned problems in the prior art.

EXAMPLE 5

After the anodized aluminum treatment, the surfaces of sleeves were roughened by sand blast treatment with abrasive particles having different particle diameters at different air pressures to obtain various surface roughnesses in the range of 0.05–10μ. The sleeves having these roughened surfaces were assembled into the development apparatus shown in FIG. 10. If the surface roughness was in the range of 0.1μ or less, the toner was uniformly coated on the roughened surfaces with irregularities since the toner particles slipped on thereon. If the surface roughness was in the range of 8μ or more, the toner particles did not slip on the sleeve surfaces without any irregularity. However, the toner particles penetrated into the recesses onto the roughened surfaces so that the toner particles would not be charged under insufficient friction therebetween to decrease the toner particles in developing ability resulting in poor images with their reduced image densities. The roughened surfaces of the sleeves were particularly effective if their surface roughnesses were in the range of 0.3–3.0μ with the pitches being in the range of 5–30μ.

When image development was carried out after the sleeves had been run idle for 500 rrs in the presence of the toner, high quality images were still obtained. Observing the sleeve surfaces by the scan type electron microscope at this time, it has been found that they are maintained at their original states with no abrasion.

In the above examples 1 to 5, the surface roughness is represented by JIS ten-point mean roughness (Rz) (JIS B0601).

What we claim is:

1. An apparatus for developing latent images on latent-image carrying means by the application of developer, comprising:

developer supporting means for carrying developer on its surface;

magnetic-field producing means enclosed by said developer supporting means;

means for supplying one-component magnetic developer to said developer supporting means; and means, disposed adjacent to said developer supporting means, for controlling the amount of said developer on the surface of said developer supporting means;

the surface of said developer supporting means being roughened by sand blast treatment, wherein the pitch of said roughened surface is in the range of 2 to 50μ and the surface roughness of said roughened surface is in the range of 0.1 to 8μ.

2. An apparatus defined in claim 1 wherein said sand blast treatment is carried out by use of irregularly shaped particles.

3. An apparatus for developing latent images on latent-image carrying means by the application of developer, comprising:

developer supporting means for carrying developer on its surface;

magnetic-field producing means enclosed by said developer supporting means;

means for supplying one-component magnetic developer to said developer supporting means; and means, disposed adjacent to said developer supporting means, for controlling the amount of said developer on the surface of said developer supporting means;

the surface of said developer supporting means being roughened by sand blast treatment and then plated.

4. An apparatus defined in claim 3 wherein said sand blast treatment is carried out by use of irregularly shaped particles.

5. An apparatus defined in claim 3 wherein the pitch in said roughened surface is in the range of 2 to 50μ.

6. An apparatus defined in claim 3 wherein the surface roughened in said roughed surface is in the range of 0.1 to 8μ.

7. An apparatus defined in claim 3 wherein said plating is hard chrome plating.

8. An apparatus defined in claim 3 or 7 wherein said plating is in the range of 1 to 20μ in thickness.

9. An apparatus for developing latent images on latent-image carrying means by the application of developer, comprising:

developer supporting means for carrying developer on its surface;

magnetic-field producing means enclosed by said developer supporting means;

means for supplying one-component magnetic developer to said developer supporting means; and means, disposed adjacent to said developer supporting means, for controlling the amount of said developer on the surface of said developer supporting means;

the surface of said developer supporting means being roughened by sand blast treatment and thereafter subjected to anodized aluminum treatment.

10. An apparatus defined in claim 9 wherein said sand blast treatment is carried out by use of irregularly shaped particles.

11. An apparatus defined in claim 9 wherein the pitch in said roughened surface is in the range of 2 to 50μ.

12. An apparatus defined in claim 9 wherein the surface roughened in said roughed surface is in the range of 0.1 to 8μ.

13. An apparatus defined in claim 9 wherein the anodized aluminum layer on said developer supporting means formed by said anodized aluminum treatment consists of anodized hard aluminum.

14. An apparatus defined in claim 9 or 13 wherein the anodized aluminum layer formed by said anodized aluminum treatment is in the range of 5 to 50μ in thickness.

15. An apparatus defined in claim 9 wherein said sand blast treatment is carried out by use of regularly shaped and sized particles.

16. An apparatus for developing latent images on latent-image carrying means by the application of developer, comprising:

developer supporting means for carrying developer on its surface;

magnetic-field producing means enclosed by said developer supporting means;

means for supplying one-component magnetic developer to said developer supporting means; and means, disposed adjacent to said developer supporting means, for controlling the amount of said developer on the surface of said developer supporting means;

the surface of said developer supporting means being subjected to anodized aluminum treatment and thereafter roughened by sand blast treatment with irregularly shaped particles.

17. An apparatus defined in claim 16 wherein the pitch in said roughened surface is in the range of 2 to 50μ.

18. An apparatus defined in claim 16 wherein the surface roughened in said roughed surface is in the range of 0.1 to 8μ.

19. An apparatus defined in claim 16 wherein the anodized aluminum layer formed by said anodized aluminum treatment consists of anodized hard aluminum.

20. An apparatus defined in claim 16 or 19 wherein the anodized aluminum layer formed by said anodized aluminum treatment is in the range of 5 to 50μ in thickness.

21. An apparatus defined in claim 20 wherein the anodized aluminum layer is formed by said anodized aluminum treatment in a larger thickness and thereafter ground into the desired thickness in the range of 5 to 50μ.

22. An apparatus for developing latent images on latent-image carrying means by the application of developer, comprising:

developer supporting means for carrying developer on its surface;

magnetic-field producing means enclosed by said developer supporting means;

means for supplying one-component magnetic developer to said developer supporting means; and means, disposed adjacent to said developer supporting means, for controlling the amount of said developer on the surface of said developer supporting means;

the surface of said developer supporting means being subjected to anodized aluminum treatment and thereafter roughened by sand blast treatment with regularly shaped particles.

23. An apparatus defined in claim 22 wherein the pitch in said roughened surface is in the range of 2 to 50μ.

24. An apparatus defined in claim 22 wherein the surface roughness in said roughened surface is in the range of 0.1 to 8μ.

25. An apparatus defined in claim 22 wherein the anodized aluminum layer formed by said anodized aluminum treatment consists of anodized hard aluminum.

26. An apparatus defined in claim 22 or 25 wherein the anodized aluminum layer formed by said anodized aluminum treatment is in the range of 5 to 50μ in thickness.

27. An apparatus defined in claim 26 wherein the anodized aluminum layer is formed by said anodized aluminum treatment in a larger thickness and thereafter ground into the desired thickness in the range of 5 to 50μ.

28. An apparatus defined in claim 1, 3, 9, 16 or 22 wherein the particles used in said sand blast treatment are in the range of #300 to #800 in particle size.

29. An apparatus defined in claim 1, 3, 9, 16 or 22 wherein the pitch in said roughened surface is in the range of 5 to 30μ and the surface roughness therein is in the range of 0.3 to 3.0μ.

30. An apparatus defined in claim 2, 4, 10 or 16 wherein said irregularly shaped particles are selected from the group consisting of $Al_2O_3$, $SiO_2$, $Fe_2O_3$, SiC and $TiO_2$.

31. An apparatus defined in claim 15 or 22 wherein said regularly shaped particles are selected from the group consisting of glass beads, steel balls and ferite balls.

32. An apparatus defined in claim 1, 3, 9, 16 or 22 wherein said means for controlling the amount of said developer is in the form of magnetic blade and wherein said magnetic-field producing means includes a magnetic pole located opposed to said magnetic blade.

33. An apparatus defined in claim 32 wherein said magnetic blade is adapted to control the developer on said developer supporting means into the desired thickness equal to or less than the gap between said developer supporting means and said latent-image carrying means.

34. An apparatus defined in claim 33 wherein an electric alternating field is applied to the gap between said developer supporting means and said latent-image carrying means.

35. An apparatus defined in claim 34 wherein the roughened surface of said developer supporting means has a surface roughness in the range of 0.1 to 4$\mu$.

36. An apparatus for developing latent images on latent-image carrying means by the application of developer, comprising:

a movable sleeve of non-magnetic material for carrying one-component magnetic toner on its surface;

a magnet roller fixedly disposed within said sleeve;

means for supplying said one-component magnetic toner to said surface of said sleeve;

a magnetic doctor blade for controlling the thickness of the magnetic toner layer formed on said sleeve, said doctor blade being disposed opposed to the magnetic pole of said magnet roller to form a magnetic field between said magnetic blade and said magnet roller by which said magnetic toner layer will be controlled into a uniform thickness less than the gap between said sleeve and said latent-image carrying means; and means for applying an electric alternating field to the gap between said sleeve and said latent-image carrying means;

the surface of said sleeve being subjected to anodized aluminum treatment and thereafter roughened by sand blast treatment with irregularly shaped particles.

37. An apparatus defined in claim 36 wherein the pitch in said roughened surface of said sleeve is in the range of 2 to 50$\mu$.

38. An apparatus defined in claim 36 wherein the surface roughness in said roughened surface is in the range of 0.1 to 8$\mu$.

* * * * *

UNITED STATES PATENT AND TRADEMARK OFFICE

CERTIFICATE OF CORRECTION

PATENT NO. : 4,380,966

DATED : April 26, 1983

INVENTOR(S) : KATSUMI MURAKAMI, ET AL.

It is certified that error appears in the above-identified patent and that said Letters Patent is hereby corrected as shown below:

Col. 2, line 57, change "of upstream" to --upstream of--.

Col. 7, line 12, change "of upstream" to --upstream of--.

Col. 9, line 42, delete "to".

Col. 14, line 21, change "0.82μ" to --0.8μ--.

Col. 15, line 12, change "sleve" to --sleeve--.

Col. 17, line 9, change "roughened" to --roughness--;

line 9, change "roughed" to --roughened;

line 36, change roughened" to --roughness--;

line 36, change "roughed" to --roughened--.

Col. 18, line 2, change "roughened" to --roughness--;

line 2, change "roughed" to --roughened--.

Signed and Sealed this

*Twenty-second* Day of *November 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,380,966

DATED : April 26, 1983

INVENTOR(S) : KAZUO ISAKA, ET AL.

It is certified that error appears in the above-identified patent and that said Letters Patent is hereby corrected as shown below:

Col. 2, line 57, change "of upstream" to --upstream of--.

Col. 7, line 12, change "of upstream" to --upstream of--.

Col. 9, line 42, delete "to".

Col. 14,line 21, change "0.82μ" to --0.8μ--.

Col. 15,line 12, change "sleve" to --sleeve--.

Col. 17,line 9, change "roughened" to --roughness--;

line 9, change "roughed" to --roughened--;

line 36, change "roughened" to --roughness--;

line 36, change "roughed" to --roughened--.

Col. 18,line 2, change "roughened" to --roughness--;

UNITED STATES PATENT AND TRADEMARK OFFICE

CERTIFICATE OF CORRECTION

PATENT NO. : 4,380,966

DATED : April 26, 1983

INVENTOR(S) : Kazuo Isaka et al.

It is certified that error appears in the above-identified patent and that said Letters Patent is hereby corrected as shown below:

Column 18, line 2, change "roughed" to -- roughened --.

This certificate supersedes Certificate of Correction issued November 22, 1983.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*